US008272907B2

(12) United States Patent
Lindstrom

(10) Patent No.: US 8,272,907 B2
(45) Date of Patent: Sep. 25, 2012

(54) SECTIONALIZED SPORTS BOARD

(76) Inventor: Michael W. Lindstrom, Healdsburg, CA (US)

( * ) Notice: Subject to any disclaimer, the term of this patent is extended or adjusted under 35 U.S.C. 154(b) by 0 days.

(21) Appl. No.: 13/033,563

(22) Filed: Feb. 23, 2011

(65) Prior Publication Data

US 2011/0207376 A1 Aug. 25, 2011

Related U.S. Application Data

(60) Provisional application No. 61/307,256, filed on Feb. 23, 2010.

(51) Int. Cl.

| | |
|---|---|
| ***A63C 5/03*** | (2006.01) |
| ***B63B 35/81*** | (2006.01) |
| ***B63B 7/04*** | (2006.01) |

(52) U.S. Cl. ..... 441/74; 114/352

(58) Field of Classification Search ..... 114/39.14, 114/65 A, 65 R, 77 A, 77 R, 352, 354, 266; 441/65, 74, 79

See application file for complete search history.

(56) References Cited

U.S. PATENT DOCUMENTS

| | | | | |
|---|---|---|---|---|
| 3,996,868 | A * | 12/1976 | Schagen | 114/39.14 |
| 4,807,549 | A | 2/1989 | Rhodes | |
| 5,711,692 | A * | 1/1998 | Pope | 441/74 |
| 6,241,568 | B1 | 6/2001 | Simms | |
| 7,121,909 | B1 * | 10/2006 | Meyerhoffer | 441/74 |
| 8,123,580 | B1 * | 2/2012 | Meyerhoffer | 441/74 |
| 2008/0210137 | A1 * | 9/2008 | Cox | 108/51.3 |
| 2010/0024709 | A1 * | 2/2010 | Griffin | 114/352 |

* cited by examiner

*Primary Examiner* — Lars A Olson
*Assistant Examiner* — Anthony Wiest
(74) *Attorney, Agent, or Firm* — Craig M. Stainbrook; Stainbrook & Stainbrook, LLP

(57) ABSTRACT

A sectionalized sports board including a plurality of board sections and a post-tensioning apparatus incorporated into a board stringer and operatively disposed between the sections along the longitudinal axis of each section. The post-tensioning apparatus includes a post-tensioning cable slidably inserted into a cable chase disposed in each of the board sections, and a cable tension adjustment for selectively coupling the sections into a configuration for use of the board or for separating the board sections so that they can be folded into a compact collapsed configuration. The post-tensioning cable is permanently anchored at its ends, and when the post-tensioning cable is in a stressed condition, the board sections are abutted to provide a useable and rigid board configuration, and when the post-tensioning cable is unstressed, the board sections may be folded into a compact collapsed configuration.

17 Claims, 8 Drawing Sheets

385

210a
150a
200
140a
210
140
320
210b
220a
155
300
140b
165
280
160a
160
220b
320
175
260
160b
185
240
180a
230a
180
230d
230b
180b
410
380
370
420
190b
230
190
185
250
190a
170b
270
175
220
170
165
290
170a
150b
310
155
150

SECTIONALIZED SPORTS BOARD

CROSS REFERENCES TO RELATED APPLICATIONS

The present application claims the benefit of U.S. Provisional Patent Application Ser. No. 61/307,256, filed Feb. 23, 2010 (Feb. 23, 2010).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to sports boards, and more particularly to collapsible sports boards, and still more particularly to a foldable sports board having two or more separable sections and a post-tensioning system incorporated into the board for coupling the separable sections.

2. Discussion of Related Art Including Information Disclosed Under 37 CFR §§1.97, 1.98

Travel with bulky articles can be challenging and frustrating. In some instances, it can be expensive, as in air travel, in which surcharges can be imposed for oversized baggage. There is an almost universal desire by travelers to have and carry articles that are lightweight, easy to handle, and that fit into tight storage compartments and automobile trunks, and that may even be carried manageably and safely on motorcycles and bicycles, and also to avoid theft by not having to use rooftop car racks. Efforts to provide such apparatus are known. For instance:

U.S. Pat. No. 6,241,568 to Simms describes an inflatable surfboard that may be deflated easy and convenient travel. The collapsible surfboard includes an elongate inflatable bladder having a shape generally corresponding to a surfboard and having an elongate pocket. An elongate beam provides stiffening when the inflatable bladder is inflated. The elongate beam is removably insertable in the elongate pocket of the inflatable bladder.

U.S. Pat. No. 7,121,909 to Meyerhoffer teaches a system of interchangeable components includes various front panels, rear panels, adaptors, and interfaces that can be variably and removably assembled to form various customized waterboards with various performance characteristics. The coupling is temporary so that a waterboard can be disassembled and its front panel and/or rear panel used to create other waterboards.

U.S. Pat. No. 3,996,868 to Schagen, shows a sailboard having a hull assembled of several separable hull sections longitudinally clamped together with two tensioning cables extending inside two horizontally spaced longitudinal spine tubes. The tubes are joined by means of connecting sleeves, for a torsion-resistant connection between the hull sections.

U.S. Pat. No. 4,807,549 to Rhodes, et al, teaches a collapsible hull for a surfboard having sections joined at double chevron surfaces and maintained together by a post-tensioning cable disposed circumferentially around the assembled hull to function as a clamp. The double chevron surface is used to prevent relative movement in two axes, and the post-tensioning cable retains the sections together and prevents relative movement in the third axis.

However, none of the prior art reference shows a lightweight, collapsible or foldable sports board, or more particularly a surfboard, that can be molded or constructed using standard surfboard foam blanks, or that can be shaped by hand, by a computer aided CNC shaping machine to easily form any size or shape surfboard, suitable for use in heavy surf or for performance surfing, i.e., use by a surfer with considerable skill who (when "ripping") will invariably place sudden and significant tension, compression, and torsional loads on the board through rapid accelerations and carving, aerial maneuvers, and (unfortunately) falls. Accordingly, the surfboard industry in particular continues to seek ways to make surfboards stronger and yet more transportable.

Despite the foregoing efforts, and while portability and transportability are highly desirable, it would be preferable to have a board with such features without compromising the performance capabilities, strength, and durability of the board. To that end the present invention has been conceived and developed.

BRIEF SUMMARY OF THE INVENTION

In its most essential aspect, the present invention is a collapsible sectionalized sports board that includes at least a first section having a longitudinal axis, a second section separable from the first section and also having a longitudinal axis, and a post-tensioning apparatus operatively disposed between the first and second sections along the longitudinal axis of each of the board sections. The novel post-tensioning apparatus includes a post-tensioning cable slidably inserted into a cable chase disposed in each of the board sections, and a cable tension adjustment for selectively coupling the sections into a configuration for use of the board or for separating the board sections so that they can be folded into a compact collapsed configuration.

In a preferred embodiment, the wherein sports board includes a nose section, a tail section, and a medial section disposed between the nose and tails sections. The post-tensioning apparatus is incorporated into the board stringer and includes a plurality of stringer segments, each generally corresponding in length to the length of a board section in which it is installed. When the post-tensioning cable is in a stressed condition, the back end of the nose section abuts the front end of the medial section and the back end of the medial section abuts the front end of the tail section, and when the cable is unstressed, the board sections may be folded into a compact collapsed configuration in which the front section is folded onto either of the top or the bottom side of the medial section, and the tail section is folded onto the medial section on the side opposite the side onto which the front section is folded.

This summary broadly sets out the most important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
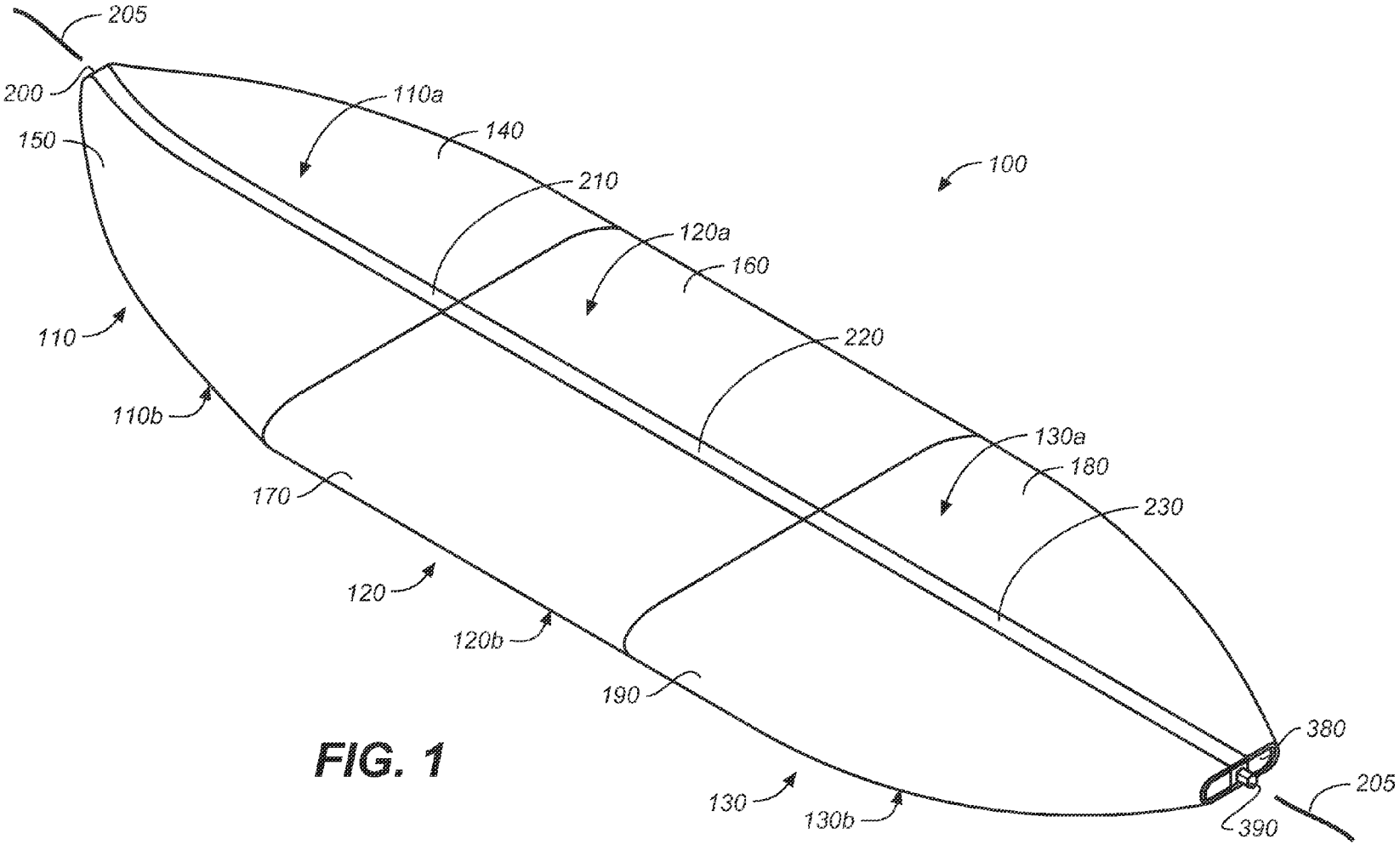
FIG. 1 is a perspective view of a first preferred embodiment of the sectionalized sports board of the present invention.
Figure 2:
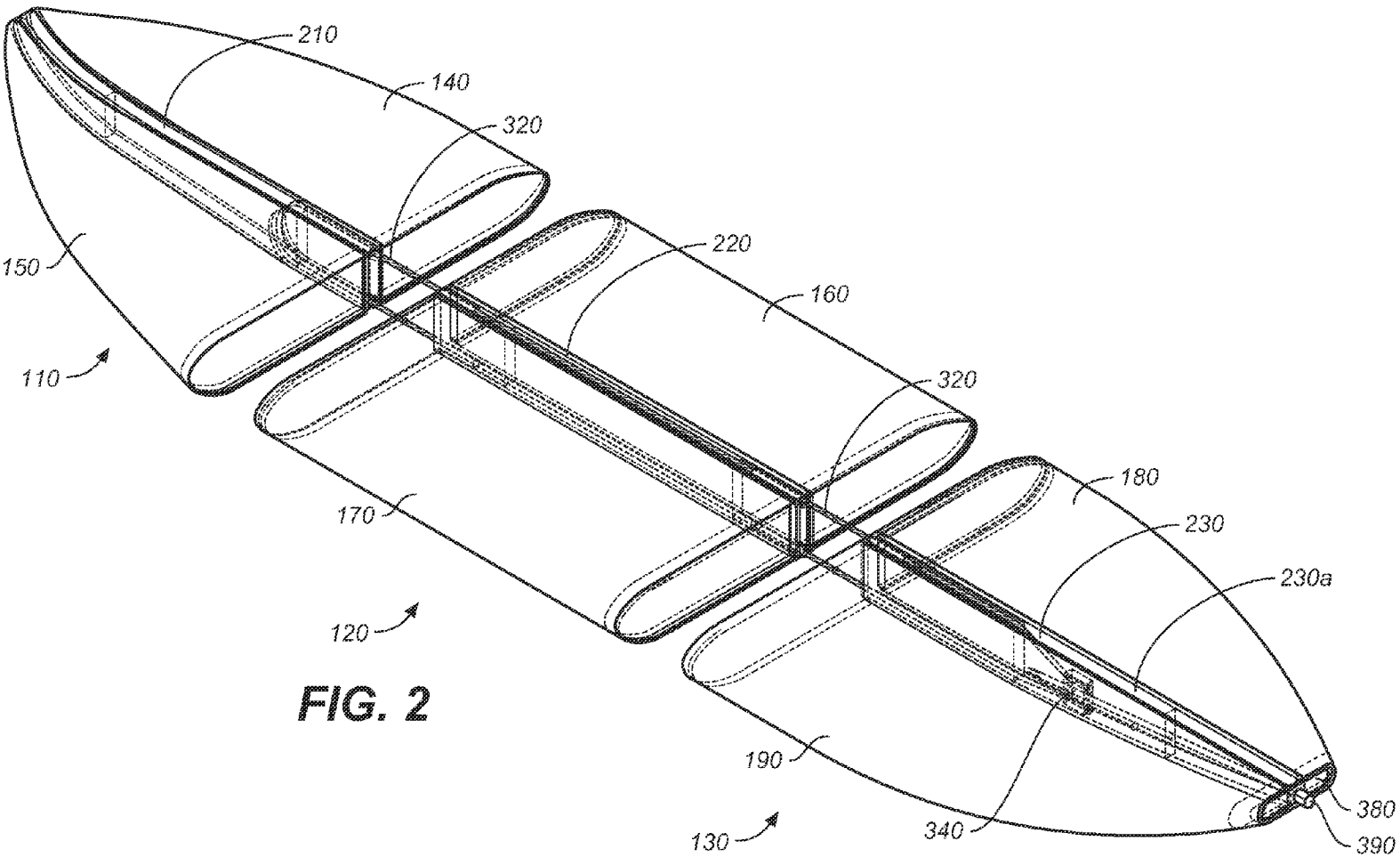
FIG. 2 is a perspective view of the sports board of FIG. 1, showing the board sections separated and positioned either for folding or for connection.

Referring to FIGS. 1 through 10, wherein like reference numerals refer to like components in the various views, there is illustrated therein the preferred embodiments of a new and improved collapsible sports board, the first preferred embodiment being illustrated in FIGS. 1-8C and generally denominated 100 herein. In its manufactured form the inventive apparatus comprises two or, preferably, three primary sections, including a front or nose section 110, a medial section 120, and a tail section 130, each made of two side-by-side panels for a total of six total portions, including a right nose panel 140, a left nose panel 150, a right medial panel 160, a left medial panel 170, and right tail panel 180 and a left tail panel 190. Each section includes a top side and a bottom side, respectively 120*a*, 120*b*, 130*a*, 130*b*, 110*a* and 110*b*.

The right and left nose panels each include a front end 140*a*, 150*a*, and a back end 140*b*, 150*b*. The right and left medial panels each include a front end 160*a*, 170*a*, and a back end 160*b*, 170*b*, respectively. The right and left tail panels each include a front end 180*a*, 190*a*, and a back end 180*b*, 190*b*, respectively.

For each joint between the medial section and the nose and tail sections, torsion resisting and compression distributing elements are provided on each section. In the preferred embodiment, the front ends 180*a*, 190*a* of the right and left tail panels 180, 190 include male torsion resistance key elements 240, 250 adapted for matable insertion between female compression distributing shoulders 260, 270, formed as a rim around the exposed rear ends 160*b*, 170*b* of the right and left medial panels 160, 170. The front ends 160*a*, 170*a* of the right and left medial panels include male torsion resisting key elements 280, 290, adapted for matable insertion between female compression distributing shoulders 300, 310 formed as a rim in the rear ends 140*b*, 150*b* of the right and left nose panels 140, 150.

Figures 3, 3A:
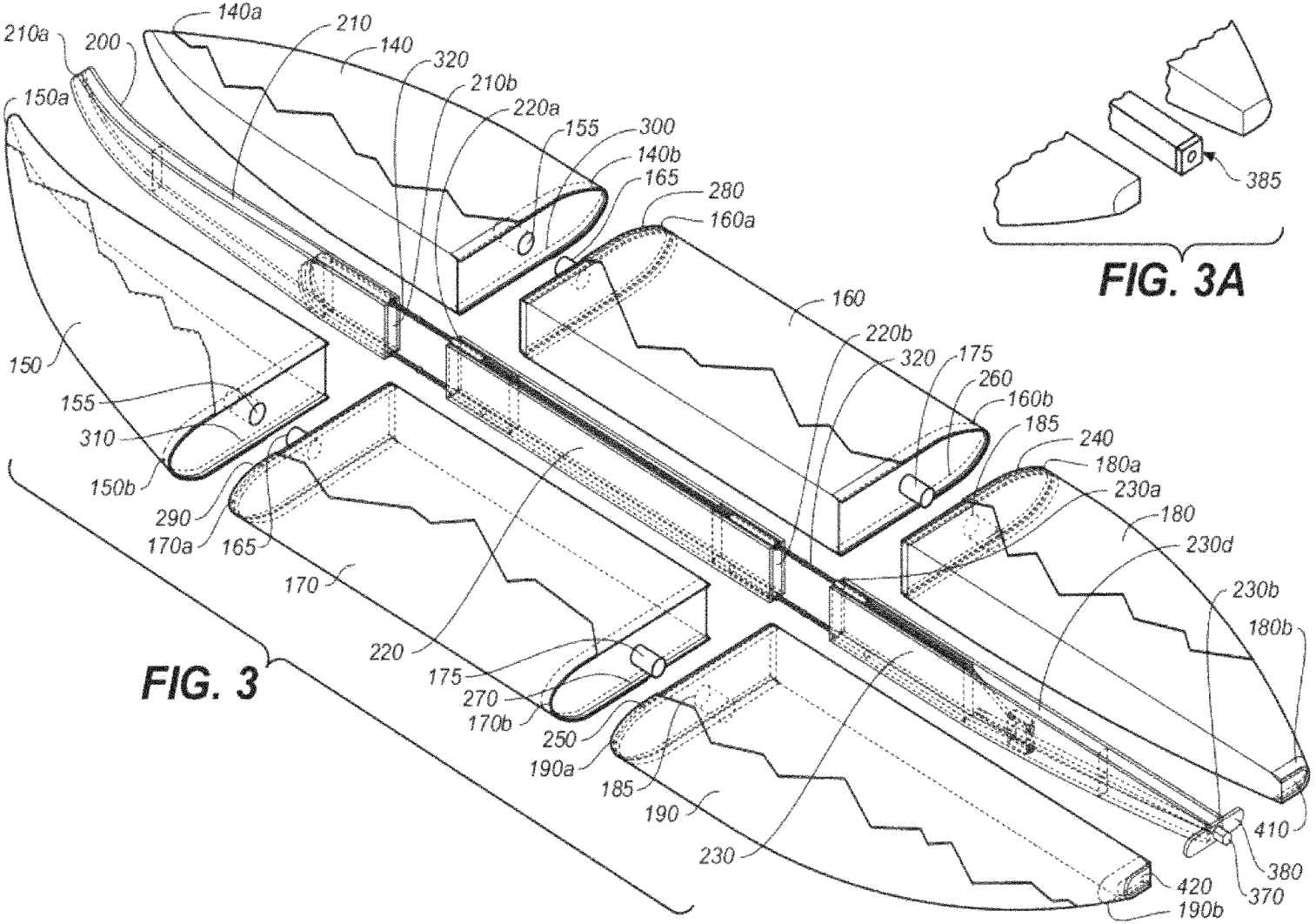
FIG. 3 is an exploded perspective view showing the principal structural components of the inventive sports board.
FIG. 3A is a partial upper rear perspective view showing an alternative stringer end plate dimensioned to match the stringer itself.
Figure 4A:
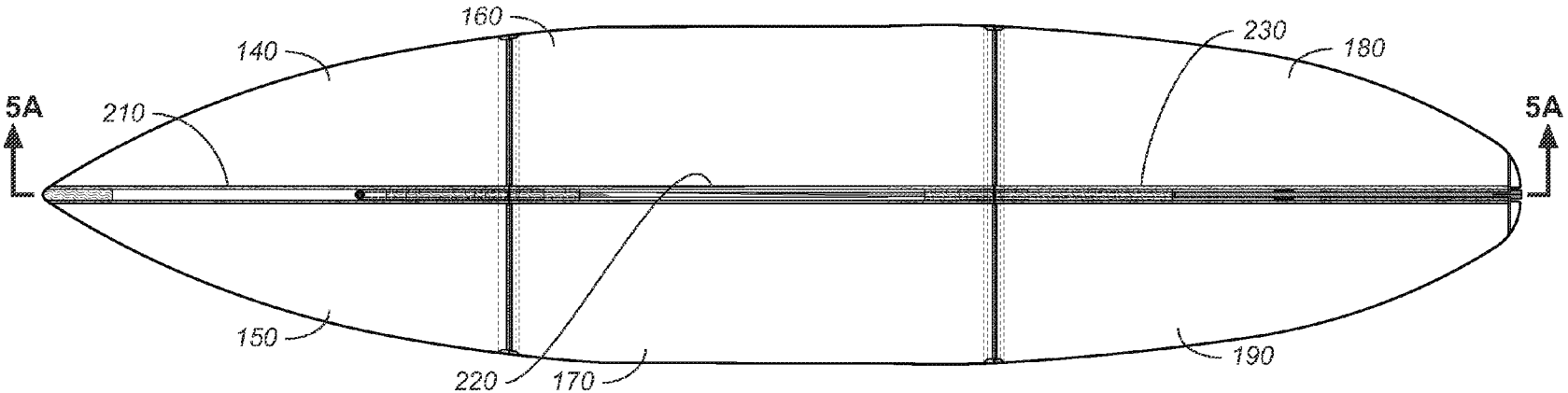
FIG. 4A is a top plan view of the sports board assembled, as in FIG. 1.
Figure 4B:
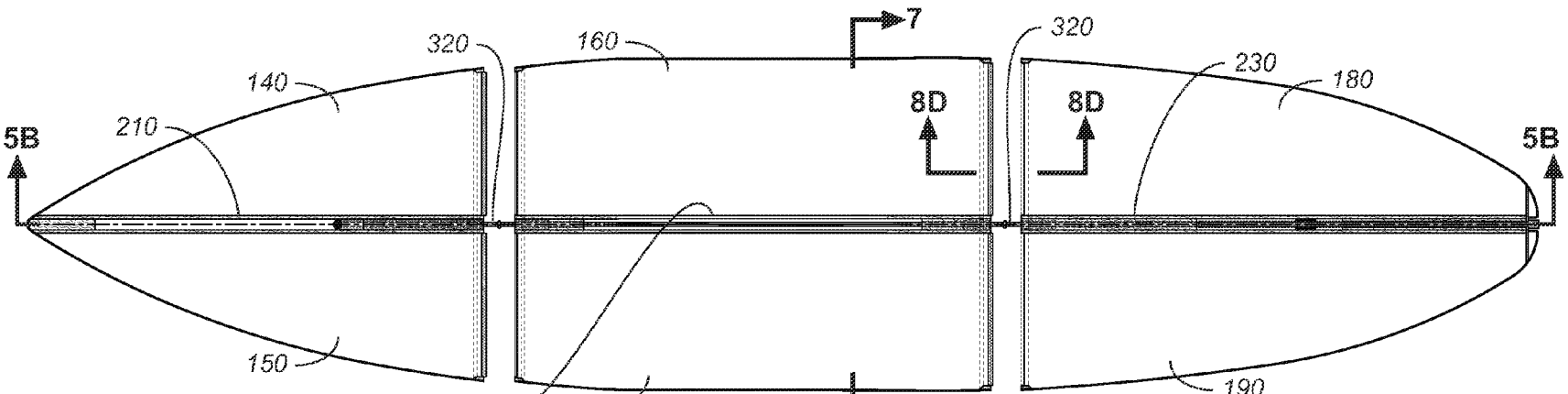
FIG. 4B is a top plan view of the sports board showing the board sections separated, as in FIG. 2.
Figure 5A:
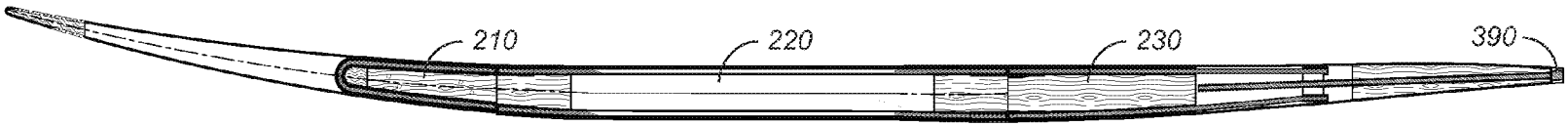
FIG. 5A is a cross-sectional side view in elevation of the sports board shown in FIGS. 1 and 4A, as taken along section line 5A-5A of FIG. 4A.
Figure 5B:
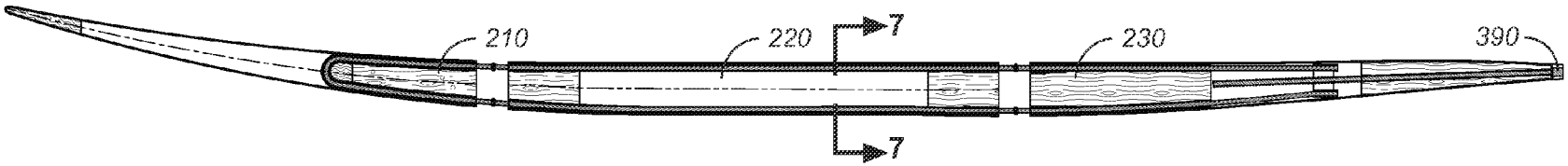
FIG. 5B is a cross-sectional side view in elevation of the sports board shown in FIGS. 2 and 4B, taken along section lines 5B-5B of FIG. 4B.
Figure 8C:
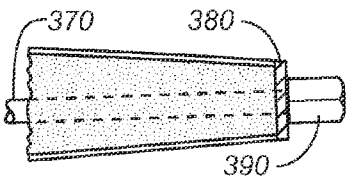
FIG. 8C shows detail of the elements for selectively tightening and loosening the post-tensioning cable at the back end of the sports board.
Figure 6:
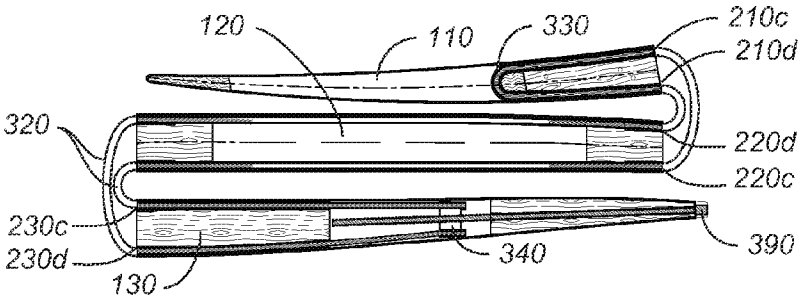
FIG. 6 shows the sports board in a folded configuration.
Figure 8D:
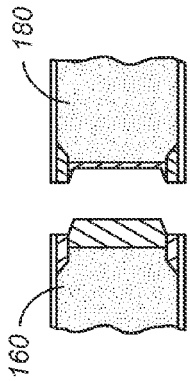
FIG. 8D is a cross-sectional side view in elevation of the medial and tail sections of the sports board taken along sections lines 8D-8D of FIG. 4B.
Figure 7:
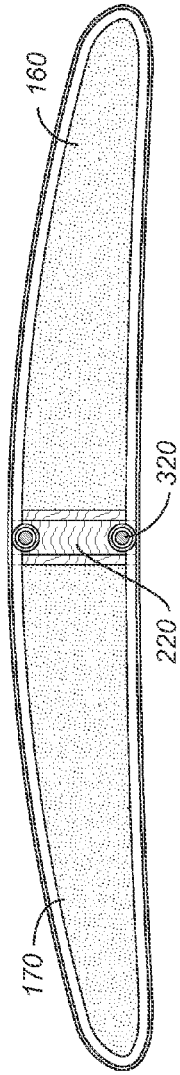
FIG. 7 is a cross-sectional end view in elevation, taken along section line 7-7 of FIGS. 4B and 5B.
Figure 8A:
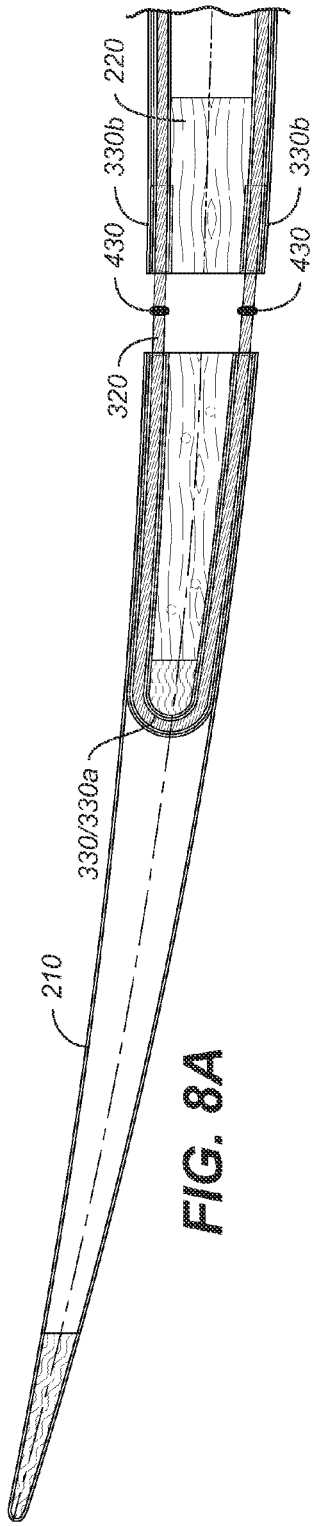
FIG. 8A is a cross-sectional side view in elevation of the nose section and the front portion of the medial section of the sports board.
Figure 8B:
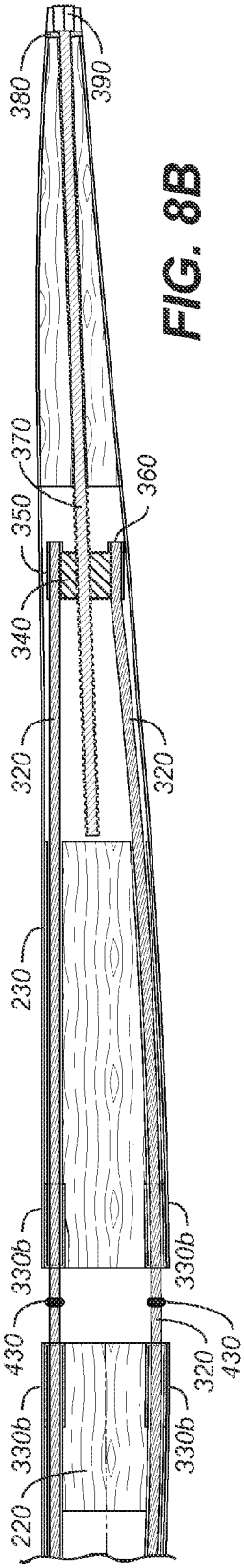
FIG. 8B is a cross-sectional side view in elevation of the tail section and rear portion of the medial section of the sports board.
Figure 9A:
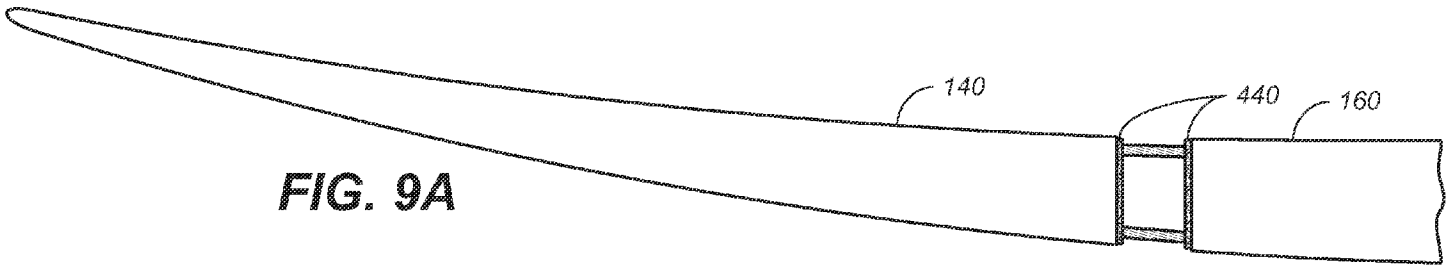
FIG. 9A is a schematic side view in elevation of second preferred embodiment of the inventive system, in which the insertable keyway elements of the first preferred embodiment are eliminated and hook and loop fastening material is provided at each end of the board sections, and the ends of the middle and end sections are not yet approximated through tightening of the post-tension cable.
Figure 9B:
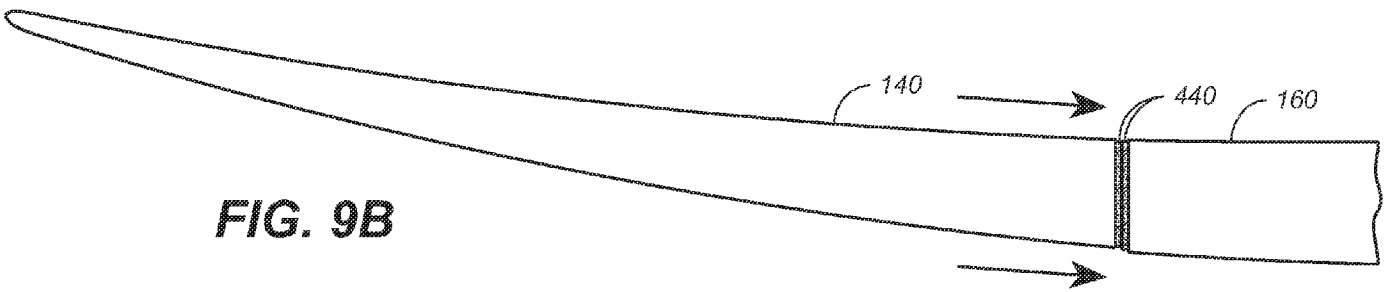
FIG. 9B is the same view as that of FIG. 9A with the cable tightened so as to bring the hook and loop fastening material into contact.
Figure 9C:
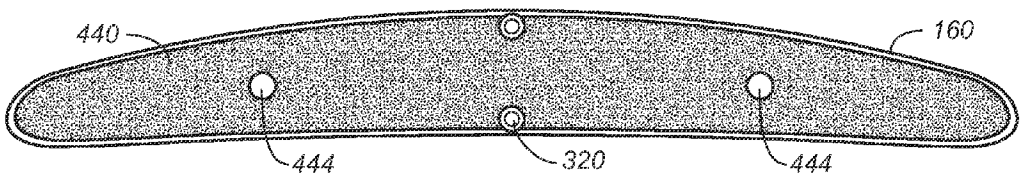
FIG. 9C is an end view showing a board section having hook and loop material disposed thereon.
Figure 9D:
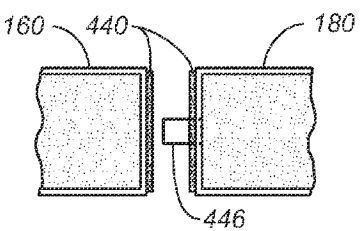
FIG. 9D is a detailed cross-sectional view in elevation also taken along section lines 8D of FIG. 4B showing the hook and loop method rather than the insertable keyway method of securing board sections to one another and further showing an indexing pin for insertion in complementary hole in an adjoining board section.

As an alternative to, or in addition to the above-described keying elements, indexing pins disposed in one or more of the board sections can be matched to indexing holes in the adjoining sections. For instance, as shown in FIG. 3, indexing pins 165 and 175 in the right and left medial panels can be matched to corresponding indexing holes 155 and 185, respectively, in the right and left nose and tail panels to assist in bringing the board sections into easy alignment, and also to provide enhanced resistance to any kind of lateral translation of the board sections in relation to one another. As will be readily appreciated, there are many suitable ways to achieve the same ends using a different number, orientation, placement, and configuration of the indexing pins and holes. The use of single pins in the medial panels with corresponding holes in the tail and end panels is but one of countless possible variations.

A post-tensioning apparatus is incorporated into the board to couple the board sections and to achieve sufficient rigidity and strength for tolerating the forces and loads that will be placed on the board during use. As with all such systems, the apparatus includes a tendon (in this instance a flexible unbonded cable), a sheathing or duct through which the unbonded cable is slidably routed, anchorage for securing the ends of the cable, and means for stressing the cable.

In the inventive sectionalized sports board, the cable sheathing is incorporated into the board stringer 200. Because stringers are routinely included in conventional non-sectionalized boards, this novel element ensures that the essential steps in the board manufacturing process can be preserved. In the present invention, the board stringer has a substantially rectangular cross sectional shape and a plurality of segments generally corresponding in length to the length of the board sections. Accordingly, in the illustrative embodiment, the stringer 200 runs the entire length of the board along its longitudinal axis 205 and is sectioned in lengths corresponding generally to the lengths of the nose, medial, and tail sections, such that it includes a nose segment 210, a medial segment 220, and a tail segment 230. Each stringer segment 210, 220, 230, includes a front end 210*a*, 220*a*, 230*a*, a rear end 210*b*, 220*b*, 230*b*, and upper and lower bores 210*c*/210*d*, 220*c*/220*d*, and 230*c*/230*d*, which, when the board is assembled, function as a continuous or substantially continuous cable sheathing or chase into which the post-tensioning cable 320 is inserted. Accordingly, the stringer has a width sufficient to accommodate a post-over tensioning cable, which is fed through either the upper or lower bore of the stringer and routed over a return 330 in the nose segment 210. Preferably, the return includes a bend having a channel or trough into which the post-tensioning cable is disposed, and such trough is preferably either a bent pipe chase through which the cable is slidably inserted, or alternatively a reinforced metal surface 330*a* (U-shaped in cross-section) so as to prevent destructive wear on the stringer material. Chase pipes 330*b* or jackets may be provided at a number of critical friction points and at panel ends for the same purpose. The cable ends terminate in anchorage, which is preferably a also a cable tension adjustment member, namely a movable jacking block 340, in which both ends 350, 360 of the cable are crimped or otherwise secured to prevent any excursion from the block during adjustments.

The stringer is generally hollow in a rearmost tail segment section 230*b* so as to accommodate the jacking block and a jacking (adjustment) rod 370, which is journaled at one end in a plate 380 at the rear 230*b* of the tail segment 230 of the stringer. The plate may include a bushing, and functions to distribute forces from the jacking nut and onto the stringer and shell of the board. A jacking nut (hex head) 390 is provided at the tail of the board for turning with a suitable wrench. The jacking rod extends to and threadably through the jacking block 340, such that turning the rod at the jacking nut results in movement fore and aft of the jacking block and the post-tensioning cable within the hollow portion of the tail segment of the stringer. The movement selectively increases or decreases separation of the board sections such that the board may either be folded into a collapsed configuration [see FIG. 6] or assembled into a rigid configuration for use. When the jacking nut is tightened so as to put the cable in a stressed condition, the rear end of the front section abuts the front end of the medial section, and the rear end of the medial section abuts the front end of the tail section. The jacking nut may extend through a shaped end plate 380 disposed over both the end of the stringer, either rearward and outwardly from the rear ends 180*b*, 190*b*, or alternatively in conforming recesses 410, 420 in the rear ends 180*b*, 190*b* of the right and left tail panels 180, 190. The end plate enhances the distribution of loads when the cable is placed in the stressed condition. However, it is not a necessary feature of the post-tensioning system when the board and board stringer are fabricated from sufficiently sturdy materials. O-rings or other suitable cable rings 430 are disposed over the post-tensioning cable between each board section and serve as gaskets to prevent water intrusion into the chase when assembled.

As will be appreciated, the post-tensioning system apparatus incorporated into the board stringer and employed in the present invention does not entail attaching and anchoring free cable when board sections are abutted. Rather, the cable remains slidably threaded through the stringer such that the board sections fold over upon one another, but do not entirely separate. In the folded configuration for a board with three sections, the nose section will fold either over or under the medial section, and the tail section will fold over or under the medial section opposite the side onto which the nose section is folded. A board having only two sections is simply folded at the single section joint.

In the alternative, as shown in FIG. 3A, an end plate 385 may be dimensioned to conform precisely to the dimensions of the end of the stringer and no recesses or other modifications need be made to the end of the sports board to accommodate a shaped plate. It has been found that a structurally sound stringer is itself sufficient to bear the compressive loads in approximating the board sections, and that no distribution of the loads outwardly from the stringer and into the board material is required for complete structural integrity in the configuration for use in engaging in the sport or recreational activity for which the board is designed.

Use of a flexible post-tensioning tendon in the form of a cable originating in the tail section and routed back to the tail section of the board through a return in the nose section is but one of several possible post-tensioning configurations. As will be readily appreciated by those with skill in the art, a single cable system could be incorporated into the board, which would include a single tendon disposed between the separable board sections in a balanced geometry, with anchorage in the end sections of the board. Means for stressing the cable could be provided at either end of the board.

In the alternative, two single tendon strands could be employed, each anchored in only one end. They could be placed in upper and lower orientations or in a side-by-side configuration. And their tensioning apparatus could be consolidated into a single element, such as the jacking block employed in the present invention, or they could be provided with independently movable anchors (e.g., wedges) that could be tightened separately.

However, the present invention employs a single tendon comprising a flexible cable originating in the tail section of the board and routed through a sheathing extending to the front section and routed back to the tail section through a return in the front section of the board. The cable is disposed in a top/bottom or upper and lower configuration, and this has been shown to provide the optimal functional strength while also simplifying the section assembly process.

The post-tensioning system employed in the sports board of the present invention is suitable for use in surfboards, windsurfing boards, wake boards, kite sailing boards, kite surfing boards, and so forth. Manufacture of a board incorporating the post-tensioning system is expected to generally follow customary practices in the respective industries. For example, when embodied in a surfboard, the manufacturing process for hand or CNC shaping may include the following method steps:

A foam core (blank) is either cut from a block to rough shape, or it is molded and, removed from the mold, and allowed to harden in the usual manner. It is then cut in half longitudinally from the nose to the tail, again, as is customary.

It should be noted at this point that the present invention allows for the use of any surfboard blank currently on the market.

Next the inventive stringer (excluding the post-tensioning cable) is glued between the two halves. The foam core is clamped until dry. Foam pieces are then set into any void in the stringer, except for the rear void.

Next, the rough blank and attached stringer is shaped by hand using standard methods or shaped on a computer aided (CNC) shaping machine to any desired size or shape.

After the blank and stringer are shaped, a channel is cut at the top and bottom surfaces of the stringer. Stainless steel and plastic tubes are set into the channels and a stainless steel semi-circular bent tube is anchored into the front section of the surfboard with resins.

The shaped blank is then sanded until smooth and, if desired, a stainless steel distribution plate is installed at the end of the rear section. Fiberglass is then laminated onto the blank with resins. This process is known as the "glass coat."

When the glass coat sets, the surfboard is cut into at least two pieces, and preferably three for optimum convenience when working with boards within the customary size ranges. The retention member used to prevent excursion of the cable under an extreme load is installed on both ends of the middle section. The holes leading into the cable raceways at the cut ends are temporarily covered to prevent resins from seeping into the raceways. A glass coat is then applied to the cut ends.

Next, the individual sections receive a "hot coat" of resin, and then an optional "gloss coat" of resin, as in standard surfboard construction. After the glass sets the raceways are exposed at the cut ends and a section of fiberglass and resin is removed from the stringer on the deck side of the rear section of the surfboard to expose the chamber that will house the jacking block system and cable ends. That chamber is temporarily filled with foam for shaping and glassing purposes. The form is then removed. Alternatively, tape can be used to prevent the chamber from resin intrusion during glassing.

Next, the cable is threaded through the raceways and crimped into the jacking block using the exposed chamber for access. The jacking rod is installed through the end of the rear section and positioned into the jacking block. The cut opening into the chamber is then sealed with a self-adhesive surfboard traction pad or other patching method.

Self-adhesive hook and loop material is affixed to opposing surfaces of the cut sections to resist torsion and lateral translation of the individual sections in relation to one another. As an alternative to this hook and loop method, when the surfboard is cut into sections and after the glass coat, a keyway can be installed at the cut sections. This keyway consists of a male and female shapes constructed of fiberglass, resin and lightweight wood or plastic material. The use of hook and loop, however, is lightweight, provides a cushion between the hard surfaces to resist spalling and prevents pinching, and, therefore, is the preferred method. In a preferred embodiment, the hook and loop method can be supplemented by the use of indexing pins and holes, as described in detail above in relation to FIG. 3.

As a final manufacturing step, the removable fins are installed using standard surfboard manufacturing methods.

In the alternative, rather than being included in a hand-shaped surfboard, CNC shaped, or pre-shaped foam surfboard, the stringer can be incorporated into a fully molded mass production "pop-out" surfboard, such as those currently fabricated from heavy EPS foam, epoxy resin, or plastic. Numerous reputable surfboard manufacturers have extended their product line to embrace these accessibly priced products. If made using a pop-out molding method, the board stringer is simply incorporated into the molding process for each board section. Otherwise, the method steps largely track the foregoing steps for hand and CNC production.

Figure 10:
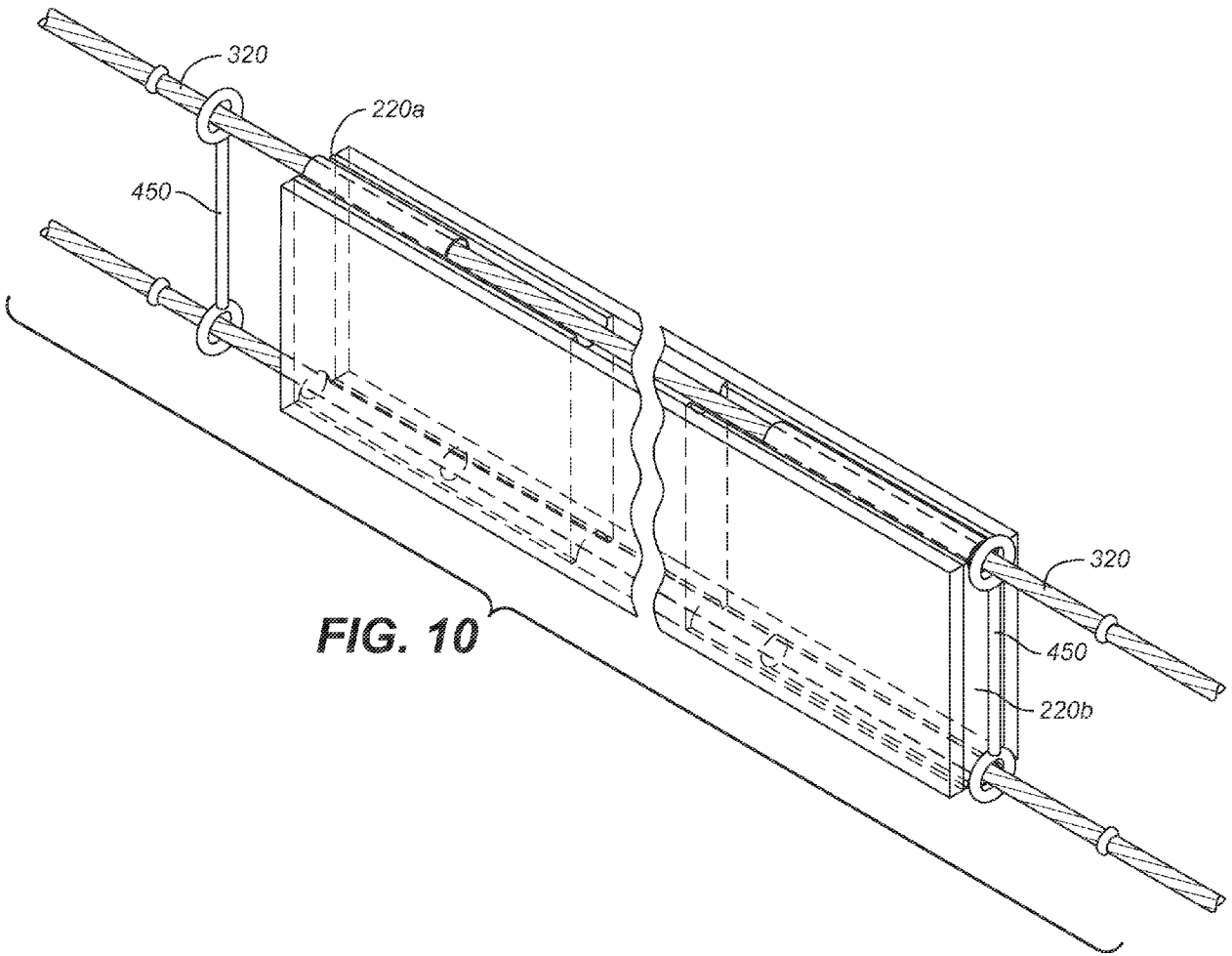
FIG. 10 is cross-sectional end view showing a retention member used to prevent excursions of the post-tensioning cable when the sports board is under compressive loads.

Referring next to FIGS. 9-10, there is shown a second preferred embodiment of the inventive sectionalized sports board. In this embodiment, the insertable male torsion resistance key elements and female compression distributing shoulders formed as a rim are eliminated and replaced by a much simpler and lighter combination of elements. Rather than insertable members, the board sections are simply provided with hook and loop fastening material 440 is provided at each interior end of the board sections. FIGS. 9A and 9D show the section ends before they are brought into contact with one another. FIG. 9D also shows an indexing pin 446 that is matched to a corresponding indexing hole 444 shown in FIG. 9C. The section ends approximated after tightening of the post-tensioning cable are shown in FIG. 9B.

FIG. 10 is an end view in perspective showing a retention member used to prevent excursions of the post-tension cable when the sports board is under compressive loads. While the stringer and fiberglass finish on a surfboard provide ample strength to retain the post-tensioning cable in its tunnel like pathway, under heavy compressive loads the cable will tend to move powerfully against the underside of the upper surface of the board. It is not inconceivable that the cable could break through the surface if the loads were sufficiently high. To eliminate even the possibility of such an event, the sports board of the present invention may be provided with a retention element 450, preferably a small rod with eyes disposed on each end. The rod is positioned at each end of the stringer in the middle section of the board, and the post-tensioning cable is fed through the eyes, such that the rod effectively restrains the cable from excursions of any significance.

In the preferred embodiments, the abutments between the board sections are shown as substantially flat or planar surfaces having either a keyway configuration, indexing pins and holes, hook and loop material, or some combination included to prevent lateral movement of the board sections. It will be appreciated that the abutting surfaces could be configured or shaped in a number of ways to provide a puzzle-fit kind of connection to accomplish essentially the same objective. Such a configuration has not been found to be necessary and makes the production process considerably more involved and complicated.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A collapsible sectionalized sports board, comprising:

a first section having a longitudinal axis;

a second section separable from said first section and having a longitudinal axis; and a post-tensioning apparatus operatively disposed between said first and said second sections along the longitudinal axis of each of said first and said second section, said post-tensioning apparatus including a cable slidably inserted into a cable chase disposed in each of said first and second sections, and a cable tension adjustment for selectively coupling said sections into a configuration for use of the board in a sport or uncoupling said sections for folding said board sections into a compact collapsed configuration;

wherein said post-tensioning apparatus is incorporated into a board stringer divided into a plurality of stringer segments, including a first segment disposed in said first section, and a second segment disposed in said second section;

wherein said board stringer has a substantially rectangular cross sectional shape and said stringer segments generally correspond in length to the length of the board section into which it is incorporated;

wherein said board stringer runs substantially the entire length of the longitudinal axis of said sports board when said board is in the functional configuration for use, and wherein said board stringer includes upper and lower bores which, when said sports board is assembled, function as a continuous or substantially continuous cable sheathing or chase into which said post-tensioning cable is slidably inserted.

2. The sports board of claim 1, wherein said first and second sections each include right and left panels in a side-by-side relationship, and wherein said post-tensioning apparatus is incorporated into a board stringer.

3. The sports board of claim 2, wherein said first section is a front section and said second section is a tail section, and further including a medial section disposed between said front and said tail sections, and wherein each of said sections includes a top side and a bottom side.

4. The sports board of claim 3, wherein said post-tensioning apparatus includes a permanently anchored cable with means to adjust the stress of said cable, and when said cable is unstressed, said board sections may be folded into a compact collapsed configuration in which said front section is folded onto either of said top or said bottom side of said medial section, and said tail section is folded onto said medial section on the side opposite the side onto which said front section is folded.

5. The sports board of claim 4, wherein said cable has two ends, and wherein in the collapsed configuration, said cable ends remain connected to at least one board section.

6. The sports board of claim 2, wherein said post-tensioning apparatus includes a permanently anchored cable slidably disposed within a cable sheath, and wherein when said cable is unstressed, said board sections may be folded into a compact collapsed configuration.

7. The sports board of claim 6, wherein said cable has two ends, and wherein in the compact collapsed configuration, said cable ends remain connected to at least one board section.

8. The sports board of claim 1, wherein said first section is a nose section, said second end is a tail section, and further including a medial section disposed between said nose section and said tail section, wherein said nose section includes a front end and a back end, said medial section includes a front end and a back end, and said tail section includes a front end and a back end, and wherein each of said front, medial, and back sections include a top side and a bottom side;

and wherein when said cable is in a stressed condition, said back end of said nose section abuts said front end of said medial section and said back end of said medial section abuts said front end of said tail section, and when said cable is unstressed, said board sections may be folded into a compact collapsed configuration in which said front section is folded onto either of said top or said bottom side of said medial section, and said tail section is folded onto said medial section on the side opposite the side onto which said front section is folded.

9. The sports board of claim 1, further including torsion resisting elements.

10. The sports board of claim 9, wherein said torsion resisting elements comprise keyway features integrated into the adjoining portions of said first and said second sections.

11. The sports board of claim 10, wherein said keyway features include male torsion resistance key elements on at least one of said board sections adapted for matable insertion between female compression distributing shoulders formed as a rim around the exposed ends of the other of said board sections.

12. The sports board of claim 9, wherein said torsion resisting elements comprise indexing pins and holes integrated into the abutting ends of said first and said second sections.

13. The sports board of claim 9, wherein said torsion resisting elements comprise hook and loop fastener material disposed on the abutting ends of said first and said second sections.

14. The sports board of claim 9, wherein said torsion resisting elements comprise hook and loop fastener material and indexing pins and holes disposed on the abutting ends of said first and said second sections.

15. The sports board of claim 1, wherein said post-tensioning cable is fed through either of said upper or lower bores and routed over a return disposed in said first segment.

16. The sports board of claim 1, wherein said stringer is partially hollow in said second segment and includes a jacking block to which said post-tensioning cable is anchored and a jacking rod threadably coupled to said jacking block and rotatably journaled at one end of the rear end the stringer, said jacking rod having a jacking nut accessible from one end of said sports board, such that turning said jacking rod at said jacking nut results in longitudinal movement fore and aft of said jacking block and thereby adjusts the stress placed on said post-tensioning cable within said hollow portion of said second segment of said stringer.

17. The sports board of claim 16, wherein adjustment of said jacking rod by turning said jacking nut selectively increases or decreases separation of said first and second board sections such that the board may either be folded into a collapsed configuration or assembled into a rigid configuration for use.

* * * * *